US009689618B2

(12) United States Patent
Hamaguchi

(10) Patent No.: US 9,689,618 B2
(45) Date of Patent: Jun. 27, 2017

(54) HEAT EXCHANGER AND AIR CONDITIONER EQUIPPED THEREWITH WITH WATER GUIDING CONDENSATE NOTCHES AND A LINEAR MEMBER

(75) Inventor: Satoshi Hamaguchi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 476 days.

(21) Appl. No.: 13/703,301

(22) PCT Filed: Jun. 10, 2011

(86) PCT No.: PCT/JP2011/063318

§ 371 (c)(1),
(2), (4) Date: Dec. 10, 2012

(87) PCT Pub. No.: WO2012/011331

PCT Pub. Date: Jan. 26, 2012

(65) Prior Publication Data

US 2013/0087315 A1 Apr. 11, 2013

(30) Foreign Application Priority Data

Jul. 20, 2010 (JP) ..... 2010-162479

(51) Int. Cl.
*F28D 1/00* (2006.01)
*F28D 1/02* (2006.01)
(Continued)

(52) U.S. Cl.
CPC ..... *F28D 1/0233* (2013.01); *F28D 1/05308* (2013.01); *F28F 1/126* (2013.01); *F28F 17/005* (2013.01); *F28D 1/05366* (2013.01)

(58) Field of Classification Search
CPC ..... F28F 1/128; F28F 9/0224; F28F 9/0226; F28F 9/0243; F28F 17/005; F28F 1/126;
(Continued)

(56) References Cited

U.S. PATENT DOCUMENTS 1,421,546 A * 7/1922 Parkin ..... 165/152
5,787,972 A * 8/1998 Beamer ..... F28F 1/128 165/152
(Continued)

FOREIGN PATENT DOCUMENTS

CN 101619950 A * 1/2010 ..... F28F 1/128
EP 962736 A2 * 12/1999
(Continued)

OTHER PUBLICATIONS

Machine translation of JP 4503682 B1—Jul. 2010 Madoka U et al.*

*Primary Examiner* — Davis Hwu
*Assistant Examiner* — Gordon Jones
(74) *Attorney, Agent, or Firm* — Birch, Stewart, Kolasch & Birch, LLP

(57) ABSTRACT

A heat exchanger (1) is provided with header pipes (2, 3), a plurality of flat tubes (4) disposed between the header pipes, and corrugated fins (6) disposed between the flat tubes (4). The end of the corrugated fin at the surface on the side, on which condensed water gathers, of the heat exchanger protrudes from an end of the flat tube (4), and a linear water-conducting member (10) is inserted between a gap (G) formed between the protruding portions of the corrugated fins. The interval between the water-conducting member and the protruding end of the corrugated fin located thereon is a distance at which the surface tension of water can act therebetween. A V-shaped cut (6*a* or 6*b*) is formed at the edge of the protruding end of the corrugated fin.

16 Claims, 9 Drawing Sheets

(51) Int. Cl.
*F28F 1/12* (2006.01)
*F28F 17/00* (2006.01)
*F28D 1/053* (2006.01)

(58) Field of Classification Search
CPC .. F28D 1/0316; F28D 1/0358; F28D 1/05308; F28D 1/05366; F28D 1/0233
See application file for complete search history.

(56) References Cited

U.S. PATENT DOCUMENTS

| | | | | |
|---|---|---|---|---|
| 5,867,904 | A * | 2/1999 | Harris | B23P 15/26 29/890.046 |
| 5,992,513 | A * | 11/1999 | Suzuki et al. | 165/133 |
| 2007/0012430 | A1* | 1/2007 | Duke et al. | 165/109.1 |
| 2007/0199686 | A1 | 8/2007 | Okinotani et al. | |
| 2011/0036550 | A1* | 2/2011 | Jiang | F28F 1/128 165/173 |
| 2011/0139428 | A1* | 6/2011 | Kim | F28F 1/128 165/181 |

FOREIGN PATENT DOCUMENTS

| | | | |
|---|---|---|---|
| JP | 57-30684 | U | 2/1982 |
| JP | 57-59108 | U | 4/1982 |
| JP | 58-81471 | U | 6/1983 |
| JP | 58-177764 | U | 11/1983 |
| JP | 59-16955 | U | 2/1984 |
| JP | 59-115277 | U | 8/1984 |
| JP | 62-34674 | U | 2/1987 |
| JP | 63-194263 | U | 12/1988 |
| JP | 2001-263861 | A | 9/2001 |
| JP | 2007-232246 | A | 9/2007 |
| JP | 2007-285673 | A | 11/2007 |
| JP | 2010002138 | A * | 1/2010 |
| JP | 4503682 | B1 * | 7/2010 |

* cited by examiner

HEAT EXCHANGER AND AIR CONDITIONER EQUIPPED THEREWITH WITH WATER GUIDING CONDENSATE NOTCHES AND A LINEAR MEMBER

TECHNICAL FIELD

The present invention relates to a side-flow type parallel-flow heat exchanger and an air conditioner equipped therewith.

BACKGROUND ART

A parallel-flow heat exchanger is widely used in, for example, vehicle air conditioners or outdoor units of air conditioners for buildings. The parallel-flow heat exchanger has a configuration in which a plurality of flat tubes are arranged between a plurality of header pipes such that a plurality of refrigerant passages in the flat tubes communicate with insides of the header pipes, and fins such as corrugated fins are disposed between the flat tubes.

FIG. 9 shows one example of a conventional side-flow type parallel-flow heat exchanger. In FIG. 9, the upper side of the plane of the figure is the upper side of the heat exchanger, and the lower side of the plane of the figure is the lower side of the heat exchanger. In a heat exchanger 1, two perpendicular header pipes 2 and 3 are arranged parallel to each other at an interval in the horizontal direction. Between the header pipes 2 and 3, a plurality of horizontal flat tubes 4 are arranged at a predetermined pitch in the perpendicular direction. Each of the flat tubes 4 is an elongated metal member formed by extrusion and has inside thereof refrigerant passages 5 for a refrigerant to flow therethrough. The flat tubes 4 are arranged with the extrusion direction thereof, which is also the longitudinal direction thereof, set to be horizontal, and thus a direction in which a refrigerant flows through the refrigerant passages 5 is also horizontal. A plurality of refrigerant passages 5 of the same sectional shape and area are arranged in the depth direction in FIG. 9, so that a perpendicular section of each of the flat tubes 4 has a harmonica-like shape. Each of the refrigerant passages 5 communicates with insides of the header pipes 2 and 3. Corrugated fins 6 are disposed between adjacent ones of the flat tubes 4.

The header pipes 2 and 3, the flat tubes 4, and the corrugated fins 6 are all made of a metal having high thermal conductivity, such as aluminum. The flat tubes 4 are fixed to the header pipes 2 and 3 by brazing or by welding, and the corrugated fins 6 are fixed to the flat tubes 4 also by brazing or by welding.

In the heat exchanger 1, refrigerant gates 7 and 8 are provided only on the header pipe 3 side. Inside the header pipe 3, two partition plates 9*a* and 9*c* are provided at an interval in the vertical direction. Inside the header pipe 2, a partition plate 9*b* is provided at a height intermediate between heights at which the partition plates 9*a* and 9*c* are provided, respectively.

When the heat exchanger 1 is used as an evaporator, a refrigerant flows in through the lower refrigerant gate 7 as shown by a solid line arrow in FIG. 9. The refrigerant that has entered through the refrigerant gate 7 is blocked by the partition plate 9*a* to be directed to the header pipe 2 via some of the flat tubes 4. This flow of the refrigerant is indicated by a left-pointing block arrow. The refrigerant that has entered the header pipe 2 is blocked by the partition plate 9*b* to be directed to the header pipe 3 via different ones of the flat tubes 4. This flow of the refrigerant is indicated by a right-pointing block arrow. The refrigerant that has entered the header pipe 3 is blocked by the partition plate 9*c* to be directed to the header pipe 2 again via still different ones of the flat tubes 4. This flow of the refrigerant is indicated by another left-pointing block arrow. The refrigerant that has entered the header pipe 2 turns around to be directed to the header pipe 3 again via still different ones of the flat tubes 4. This flow of the refrigerant is indicated by another right-pointing block arrow. The refrigerant that has entered the header pipe 3 flows out through the refrigerant gate 8. In this manner, the refrigerant flows from bottom to top forming a zigzag passage. The herein described case of using three partition plates is merely an example. The number of partition plates used and a resulting number of times the flow of a refrigerant turns around can set arbitrarily as required.

When the heat exchanger 1 is used as a condenser, the flow direction of a refrigerant is reversed. That is, a refrigerant enters the header pipe 3 through the refrigerant gate 8 as shown by a dotted line arrow in FIG. 9 and then is blocked by the partition plate 9*c* to be directed to the header pipe 2 via some of the flat tubes 4. In the header pipe 2, the refrigerant is blocked by the partition plate 9*b* to be directed to the header pipe 3 via different ones of the flat tubes 4. In the header pipe 3, the refrigerant is blocked by the partition plate 9*a* to be directed to the header pipe 2 again via still different ones of the flat tubes 4. In the header pipe 2, the refrigerant turns around to be directed to the header pipe 3 again via still different ones of the flat tubes 4. Then, the refrigerant flows out through the refrigerant gate 7 as indicated by another dotted line arrow. In this manner, the refrigerant flows from top to bottom forming a zigzag passage.

When a heat exchanger is used as an evaporator, moisture in the atmosphere condenses on the cooled surface of the heat exchanger, and thus condensate water is formed. With a parallel-flow heat exchanger, if condensate water stays on the surfaces of flat tubes or of corrugated fins, a sectional area of an air flow passage is reduced due to the water, resulting in degraded heat exchange performance.

Condensate water turns into frost on the surface of the heat exchanger if the temperature is low. This process may even proceed from frost to ice. In this specification, the term "condensate water" is intended to encompass so-called defrost water, namely, water resulting from melting of such frost or ice.

Accumulation of condensate water is problematic particularly in a side-flow type parallel-flow heat exchanger. Patent Document 1 proposes a measure to promote drainage from a side-flow type parallel-flow heat exchanger.

In the heat exchanger disclosed in Patent Document 1, drainage guides are disposed in contact with corrugated fins on a side of the heat exchanger where condensate water gathers. The drainage guides are linear members and disposed to be tilted with respect to flat tubes. At least one of both ends of each of the drainage guides is led to a lower-end side or a side-end side of the heat exchanger.

LIST OF CITATIONS

Patent Literature

Patent Document 1: JP-A-2007-285673

SUMMARY OF THE INVENTION

Technical Problem

It is an object of the present invention to improve a condensate water drainage capability of a side-flow type parallel-flow heat exchanger. It further is an object of the present invention to allow this effect to be achieved even in a case where the heat exchanger is disposed in a tilted state such that its surface on a side thereof where condensate water gathers is oriented downward.

Solution to the Problem

According to a preferred embodiment of the present invention, a heat exchanger according to the present invention is a side-flow type parallel-flow heat exchanger and includes: a plurality of header pipes that are arranged parallel to each other at an interval; a plurality of flat tubes that are arranged between the plurality of header pipes and each have inside thereof refrigerant passages communicating with insides of the header pipes; and corrugated fins that are disposed between adjacent ones of the flat tubes. In the heat exchanger, edges of the corrugated fins at a surface of the heat exchanger on a side thereof where condensate water gathers protrude from edges of the flat tubes. A linear water guide member is inserted into a gap between every adjacent ones of the protruding edges of the corrugated fins. A distance between the water guide member and the protruding edge of that one of the corrugated fins which is situated above the water guide member is such that surface tension of water is allowed to act therebetween. A V-shaped notch is formed at each edge of the corrugated fins at the protruding edges thereof.

According to a preferred embodiment of the present invention, in the heat exchanger configured as above, the V-shaped notch is formed at each of corrugation peaks and corrugation troughs of the corrugated fins.

According to a preferred embodiment of the present invention, in the heat exchanger configured as above, the V-shaped notch has such a notch depth as to expose at least part of one of the water guide members that is in contact with a portion of the corrugated fins where said V-shaped notch is formed.

According to a preferred embodiment of the present invention, in the heat exchanger configured as above, the V-shaped notch is formed in each perpendicular wall of the corrugated fins.

According to a preferred embodiment of the present invention, in the heat exchanger configured as above, the V-shaped notch is formed so that at least the deepest portion thereof extends deep to above that one of the water guide members which is situated immediately below that one of the corrugated fins in which said V-shaped notch is formed.

According to a preferred embodiment of the present invention, the heat exchanger configured above is incorporated in an outdoor unit of an air conditioner.

According to a preferred embodiment of the present invention, the heat exchanger configured as above is incorporated in an indoor unit of an air conditioner.

Advantageous Effects of the Invention

According to the present invention, in a side-flow type parallel-flow heat exchanger, edges of corrugated fins at a surface of the heat exchanger on a side thereof where condensate water gathers protrude from edges of flat tubes. A linear water guide member is inserted into a gap between every adjacent ones of the protruding edges of the corrugated fins. A distance between the water guide member and the protruding edge of that one of the corrugated fins which is situated above the water guide member is such that surface tension of water is allowed to act therebetween. Moreover, a V-shaped notch is formed at each edge of the corrugated fins at the protruding edges thereof. This configuration provides an effect of ensuring that surface tension of condensate water is allowed to act on the water guide member. There is also provided an effect that condensate water is drawn back inwardly from corners of the corrugated fins. Thus, even in a case where the heat exchanger is disposed in a tilted state such that its surface on a side thereof where condensate water gathers is oriented downward, a drainage function of the water guide member can be achieved sufficiently.

DESCRIPTION OF EMBODIMENTS

Figure 9:
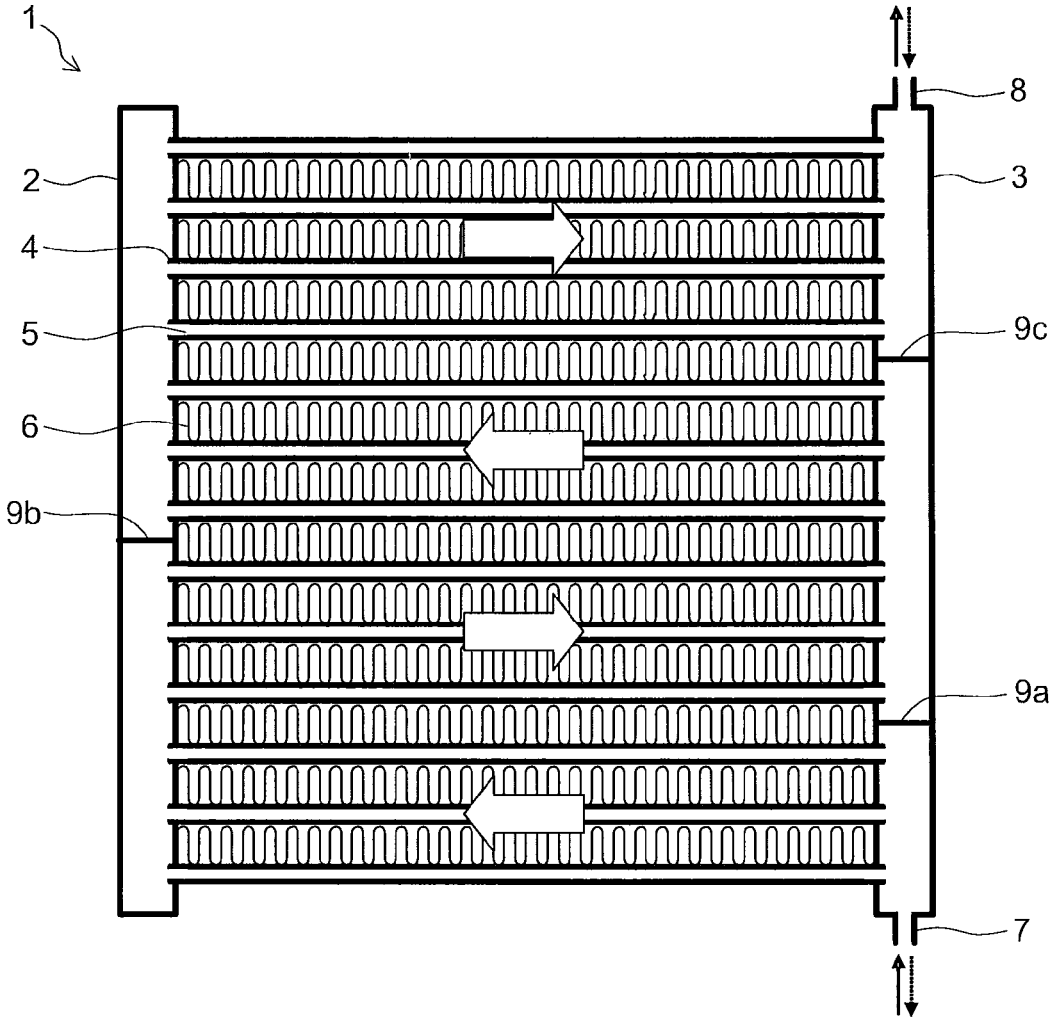
FIG. 9 is a perpendicular sectional view showing a schematic structure of a conventional side-flow type parallel-flow heat exchanger.

Hereinafter, a first embodiment of the present invention will be described with reference to FIGS. 1 to 4. In the following, constituent components functionally common to those in the conventional structure shown in FIG. 9 are denoted by the same reference symbols as in FIG. 9, and descriptions thereof are omitted.

Figure 10:
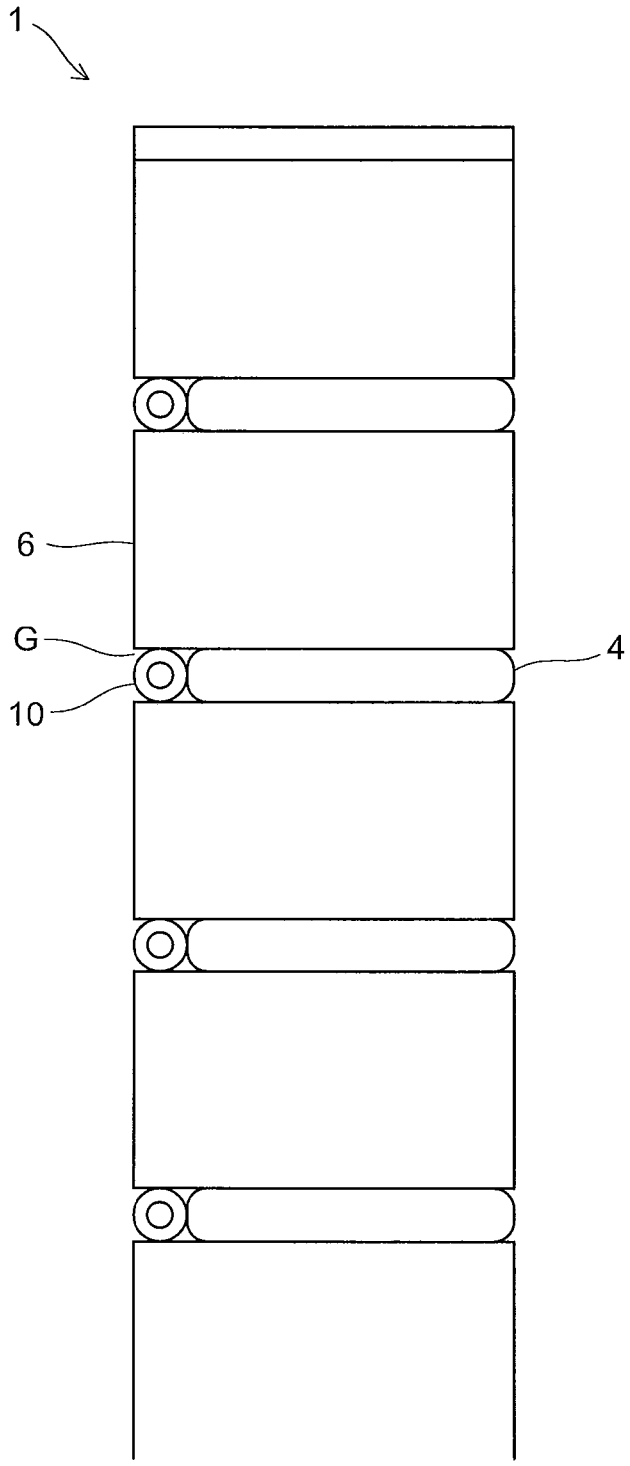
FIG. 10 is a partial schematic sectional view of the conventional side-flow type parallel-flow heat exchanger.

A drainage capability of a side-flow type parallel-flow heat exchanger 1 can be improved by forming the parallel-flow heat exchanger 1 to have a structure shown in FIG. 10. That is, in the parallel-flow heat exchanger, edges of corrugated fins 6 at a surface of the heat exchanger on a side thereof where condensate water gathers protrude from edges of flat tubes 4. A water guide member 10 is inserted into a gap G between every adjacent ones of protruding portions of the corrugated fins 6. A distance between the water guide member 10 and the protruding edge of that one of the corrugated fins 6 which is situated above the water guide member 10 is such that surface tension of water is allowed to act therebetween.

As the water guide member 10, any of the following can be used, for example: various types of water-absorbent and non-water-absorbent members allowing surface tension of condensate water to act on them, which include an assembly of fibers (preferably, synthetic fibers), namely, a so-called cord, a member formed by twisting wires or synthetic resin filaments into the shape of a double helix, a member formed by twisting wires or synthetic resin filaments into the shape of a coil spring, a member made by forming a metal or synthetic resin plate into a fine-pitch corrugated plate, a member formed in the shape of a drill bit by carving a spiral groove in the outer circumference of a metal or synthetic resin rod, a member made of a porous substance (water-absorbent member) such as a sponge, a member formed in the shape of a braid of cords, and a chain.

When condensate water is accumulated at the edges of the corrugated fins 6, a bridging phenomenon (formation of a water film) occurs in planes at the edges of the corrugated fins 6 due to surface tension of the water. A bridging phenomenon occurs not only in the planes at the edges of the corrugated fins 6 but also between the water guide member 10 inserted under each of the corrugated fins 6 and the edge of the each of the corrugated fins 6. Furthermore, a bridging phenomenon occurs also between the water guide member 10 and condensate water accumulated at the edge of that one of the corrugated fins 6 which is situated below the water guide member 10. This series of bridging phenomena forms a water guide passage extending from an upper portion to a lower portion of the heat exchanger 1 and thus makes it possible to force the condensate water forming bridges among the corrugated fins 6 to flow downward.

Figure 11:
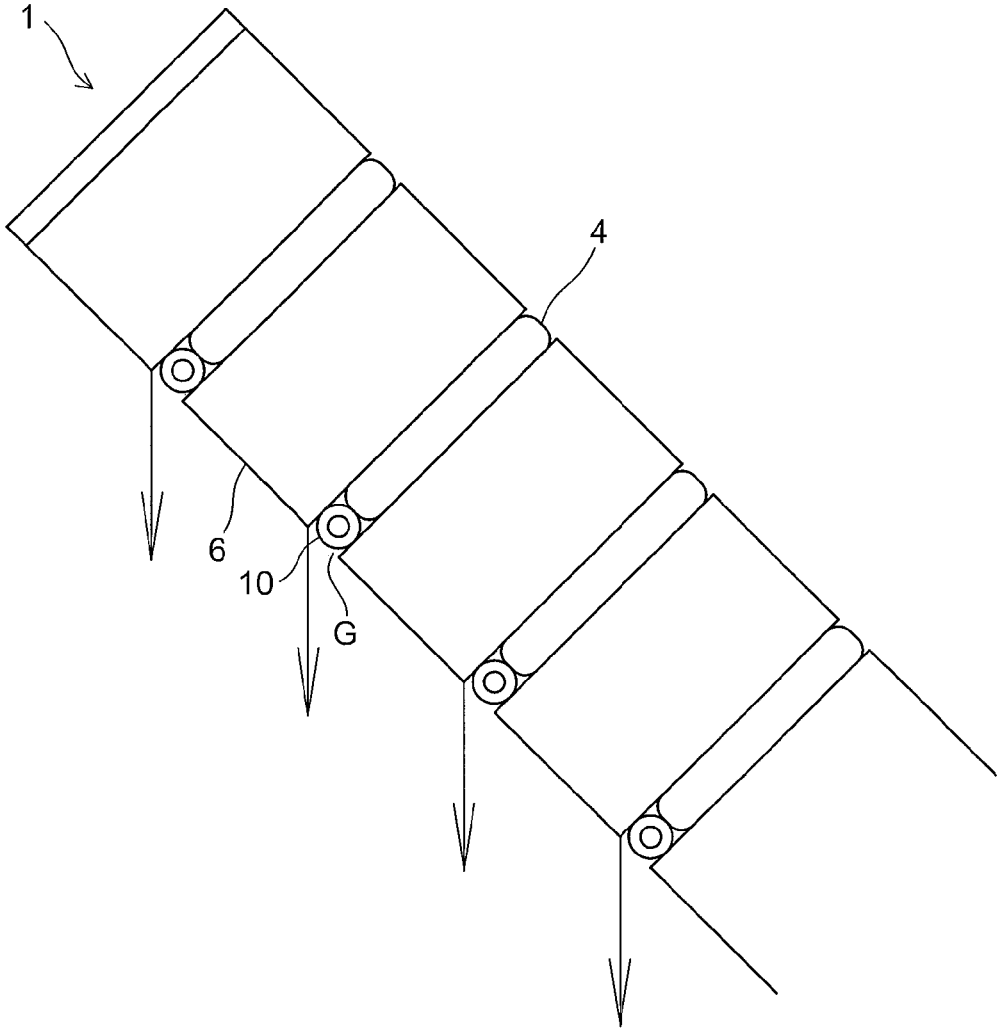
FIG. 11 is a partial schematic sectional view showing a state where the conventional side-flow type parallel-flow heat exchanger is disposed to be tilted such that its surface on a side thereof where condensate water gathers is oriented downward.

It cannot be said, however, that the side-flow type parallel-flow heat exchanger 1 shown in FIG. 10 perfectly solves the problem of drainage. When, as shown in FIG. 11, the parallel-flow heat exchanger 1 shown in FIG. 10 is disposed to be tilted such that its surface on a side thereof where condensate water gathers is oriented downward, condensate water accumulated at the edges of the corrugated fins 6 undesirably drips from lower corners of corrugations of the corrugated fins 6 before moving onto the water guide members 10 under surface tension thereof. In a case where, for example, the heat exchanger 1 is incorporated in an indoor unit of an air conditioner and a cross flow fan is installed below the heat exchanger 1, droplets of the water fly off in a mixed state with an air flow being blown out by the cross flow fan, thus causing user discomfort.

In order to solve this, the present invention has added some contrivance to the structure shown in FIG. 10. That is, at protruding edges of corrugated fins 6, a V-shaped notch 6*a* (see FIG. 2) is formed at each of corrugation peaks (portions each denoted by "T" in FIG. 1) and corrugation troughs (portions each denoted by "B" in FIG. 1) of the corrugated fins 6. The V-shaped notch 6*a* has such a notch depth as to expose at least part of one of water guide members 10 that is in contact with a portion of the corrugated fins 6 where said V-shaped notch 6*a* is formed.

While, as described earlier, various types of members can be used as the water guide member 10, herein used is a strand of two wires. For prevention of galvanic corrosion, as a material of the wires, the same material as used for flat tubes 4 and for the corrugated fins 6 is used. It follows that, if the flat tubes 4 and the corrugated fins 6 are made of aluminum, wires used are also made of aluminum. The water guide member 10 has substantially the same length as that of each of the flat tubes 4.

Figure 1:
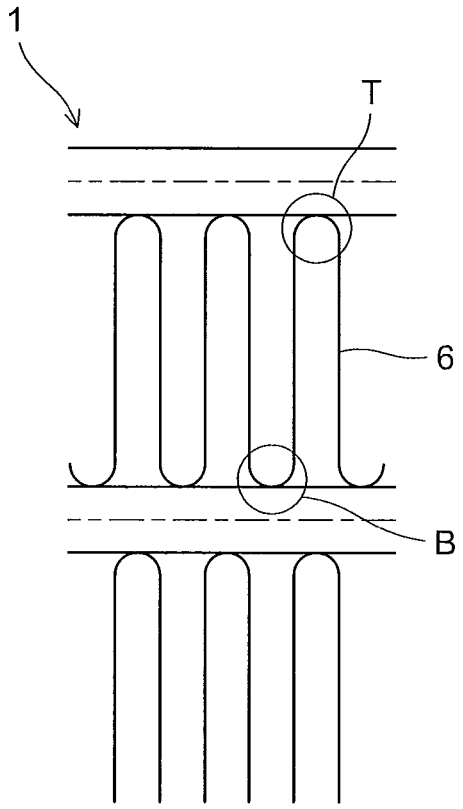
FIG. 1 is a partial front view of a heat exchanger according to a first embodiment of the present invention.
Figure 2:
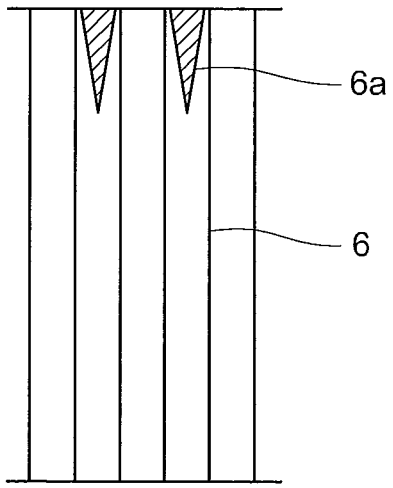
FIG. 2 is a partial top view of the heat exchanger according to the first embodiment.
Figure 3:
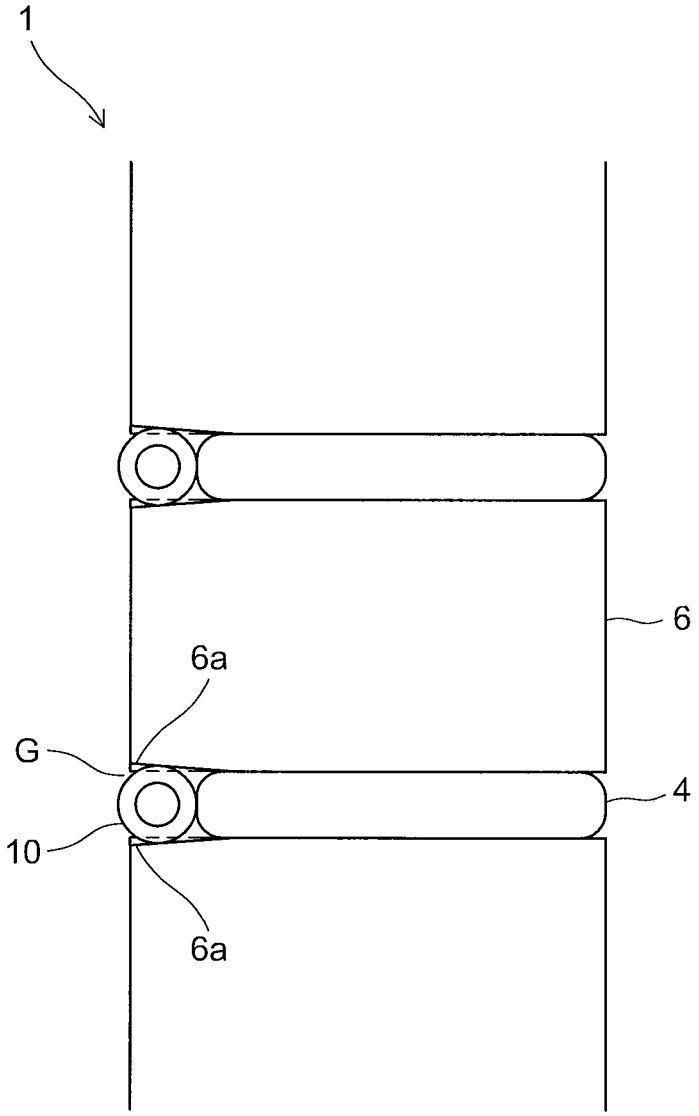
FIG. 3 is a partial schematic sectional view of the heat exchanger according to the first embodiment.
Figure 4:
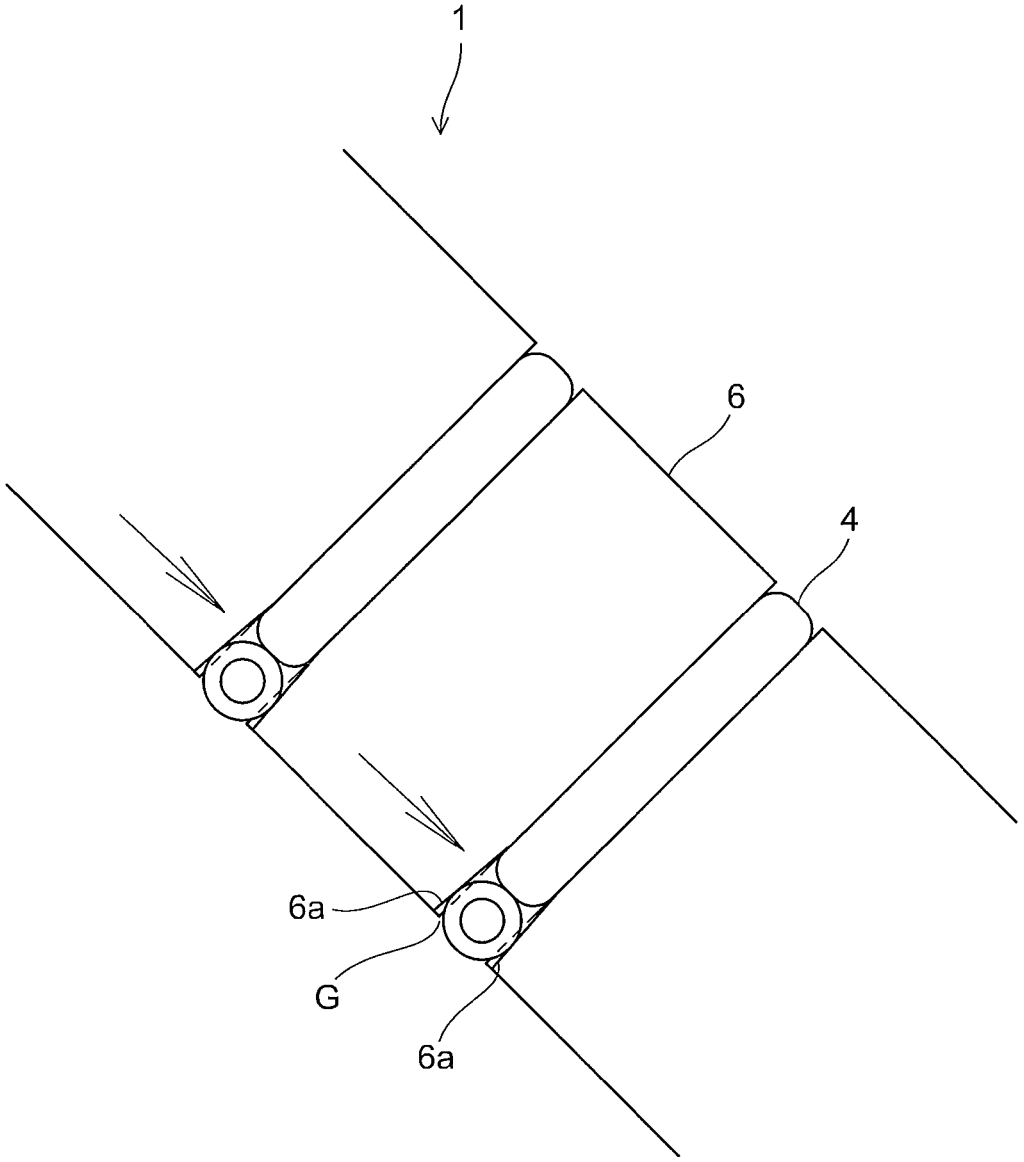
FIG. 4 is a partial schematic sectional view showing a state where the heat exchanger according to the first embodiment is disposed to be tilted such that its surface on a side thereof where condensate water gathers is oriented downward.

When the heat exchanger 1 according to the first embodiment is disposed to be tilted such that its surface on a side thereof where condensate water gathers is oriented downward, it takes a posture shown in FIG. 4. As shown by arrows in FIG. 4, condensate water that has gathered at the edges of the corrugated fins 6 flows down toward each of the corrugation troughs of the corrugated fins 6. Upon reaching the V-shaped notch 6*a*, the condensate water immediately exerts surface tension on a portion of the water guide member 10 exposed from the V-shaped notch 6*a*. This ensures that the condensate water moves onto the water guide member 10.

The condensate water that has moved onto the water guide member 10 under the surface tension moves onto that one of the corrugated fins 6 which is situated below the water guide member 10 through the V-shaped notch 6*a* formed at each corrugation peak thereof. In this manner, a water guide passage extending from an upper one of the corrugated fins 6 to a lower one of the corrugated fins 6 can be formed by a series of bridging phenomena. For purposes of collecting and draining condensate water, a water receiving and draining mechanism could be set up at a lowermost one of the corrugated fins 6 or at that one of the corrugated fins 6 which is situated slightly above the lowermost one.

According to the configuration of the first embodiment, there can be avoided a situation where condensate water drips also from the corrugated fins 6 other than the lowermost one thereof, and droplets of the water that has dripped fly off in a mixed state with an air flow being blown out by a cross flow fan disposed below the heat exchanger 1, thus causing user discomfort.

Figure 5:
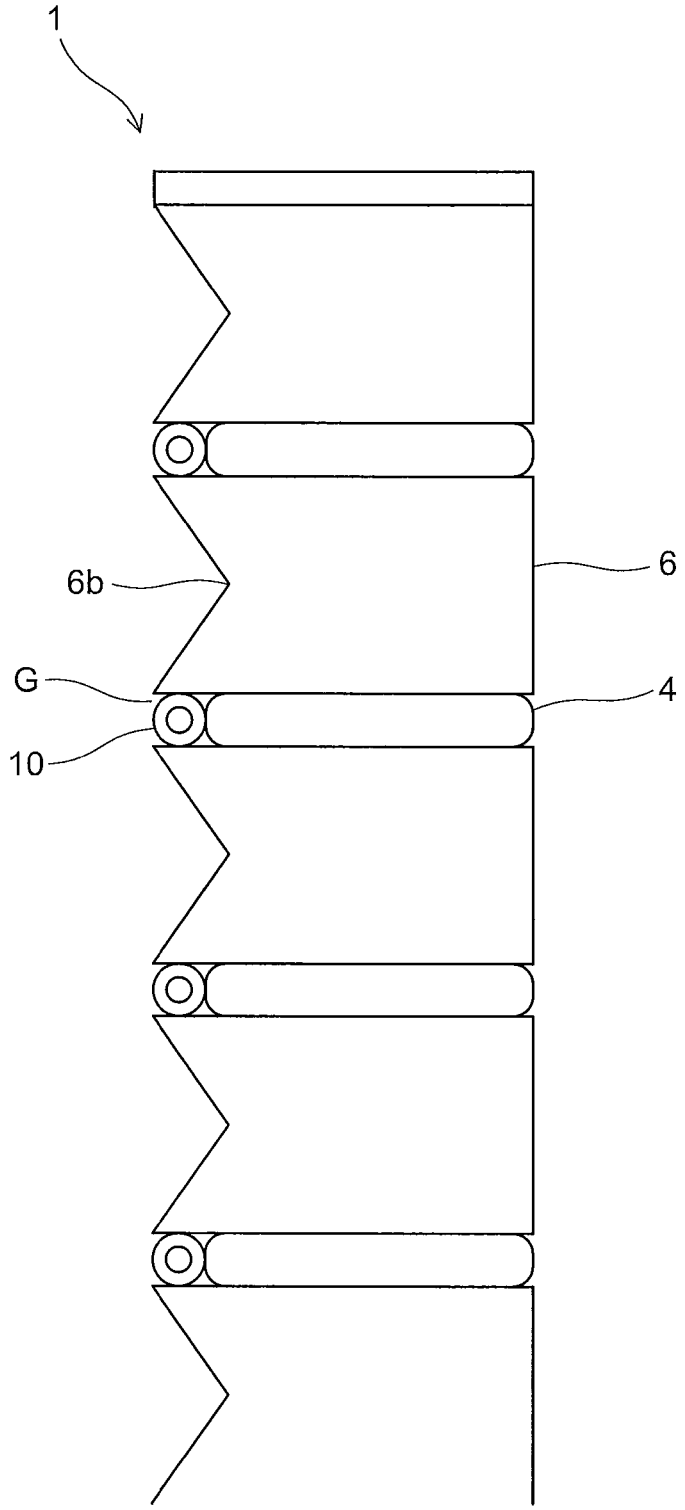
FIG. 5 is a partial schematic sectional view of a heat exchanger according to a second embodiment of the present invention.
Figure 6:
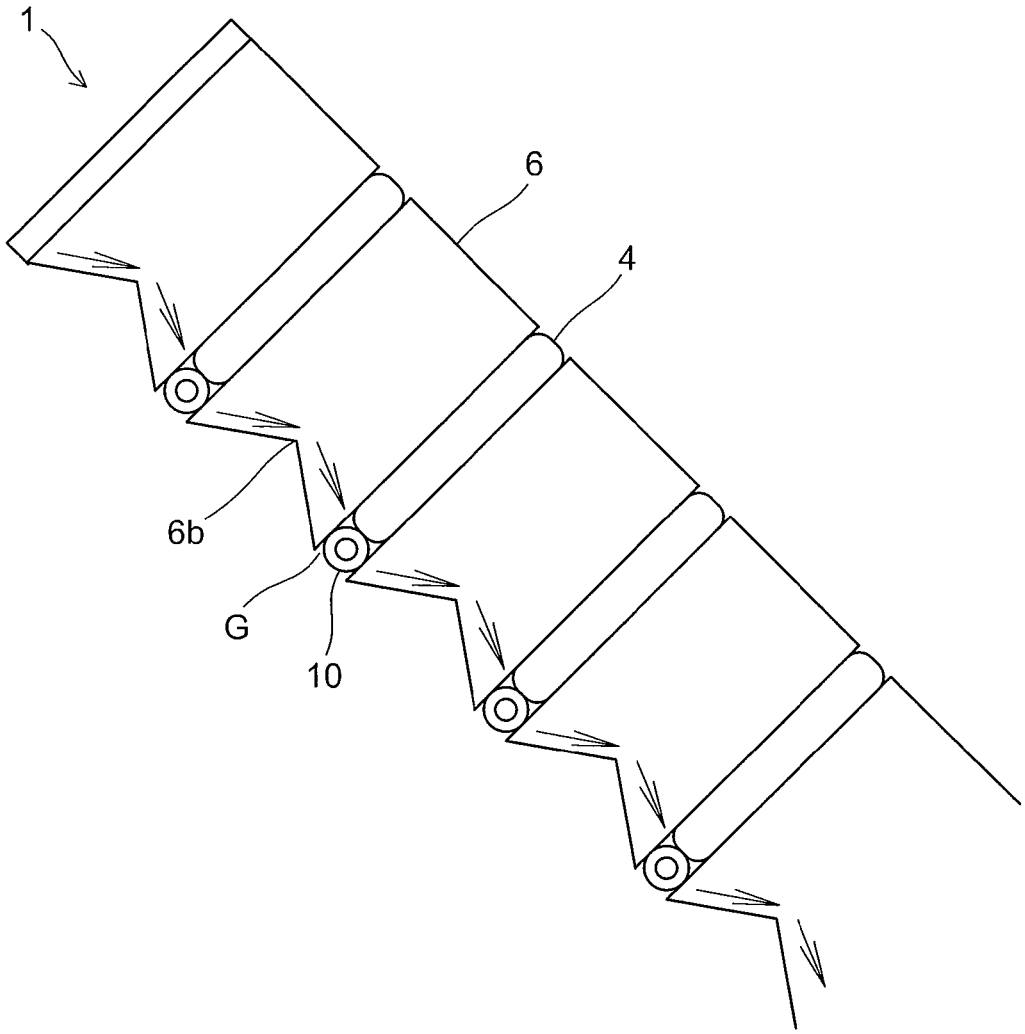
FIG. 6 is a partial schematic sectional view showing a state where the heat exchanger according to the second embodiment is disposed to be tilted such that its surface on a side thereof where condensate water gathers is oriented downward.

FIGS. 5 and 6 show a second embodiment of the present invention. Also in the second embodiment, a V-shaped notch is formed at each edge of corrugated fins 6 at protruding edges thereof but at a different location than in the first embodiment. That is, at the protruding edges of the corrugated fins 6, a V-shaped notch 6*b* is formed at an edge of each perpendicular wall of the corrugated fins 6. The V-shaped notch 6*b* is formed so that at least the deepest portion thereof extends deep to above that one of water guide members 10 which is situated immediately below that one of the corrugated fins 6 in which said V-shaped notch 6*b* is formed.

When a heat exchanger 1 according to the second embodiment is disposed to be tilted such that its surface on a side thereof where condensate water gathers is oriented downward, it takes a posture shown in FIG. 6. As shown by arrows in FIG. 6, condensate water formed at an upper portion of each of the corrugated fins 6 once moves toward a depth direction of the each of the corrugated fins 6 along an edge of the V-shaped notch 6*b* and then flows down toward the water guide member 10. Thus, unlike in the conventional structure shown in FIG. 11, condensate water is prevented from directly dripping from lower corners of corrugations of the corrugated fins 6. As a result, it is ensured that condensate water exerts surface tension on the water guide member 10, so that a water guide passage extending from an upper one of the corrugated fins 6 to a lower one of the corrugated fins 6 can be formed by a series of bridging phenomena. For purposes of collecting and draining condensate water, a water receiving and draining mechanism could be set up at a lowermost one of the corrugated fins 6 or that one of the corrugated fins 6 which is situated slightly above the lowermost one.

According to the configuration of the second embodiment, there can be avoided a situation where condensate water drips also from the corrugated fins 6 other than the lowermost one thereof, and droplets of the water that has dripped fly off in a mixed state with an air flow being blown out by a cross flow fan disposed below the heat exchanger 1, thus causing user discomfort.

It is possible to simultaneously implement the first embodiment and the second embodiment. That is, the corrugated fins 6 may have, in addition to the V-shaped notch 6*a* formed at each of the corrugation peaks and corrugation troughs thereof, the V-shaped notch 6*b* formed at each perpendicular wall thereof.

The V-shaped notches 6*a* and 6*b* need not be precisely V-shaped. Each of them may be rounded at the deepest portion thereof to be shaped like a character "U".

Figure 7:
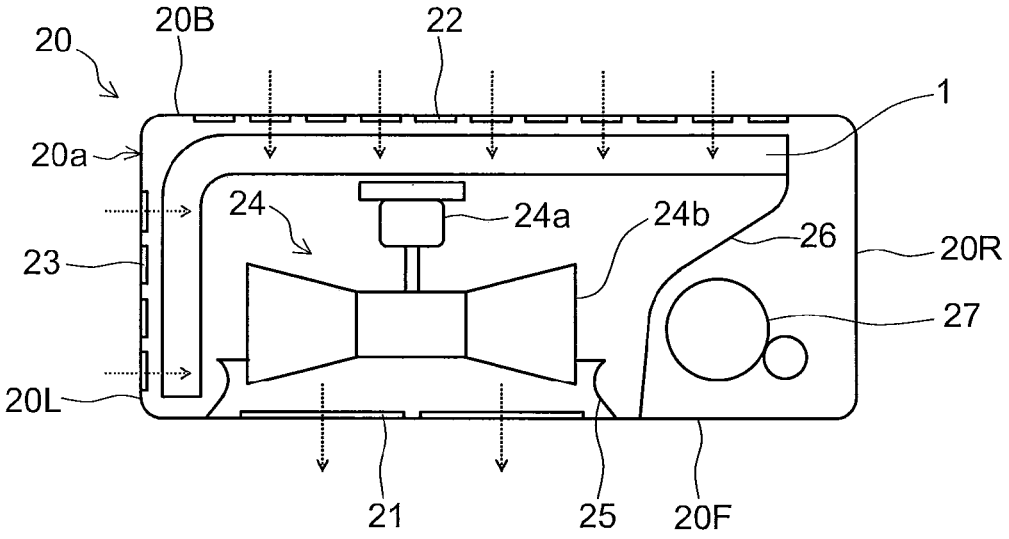
FIG. 7 is a schematic sectional view of an outdoor unit of an air conditioner equipped with the heat exchanger according to the present invention.
Figure 8:
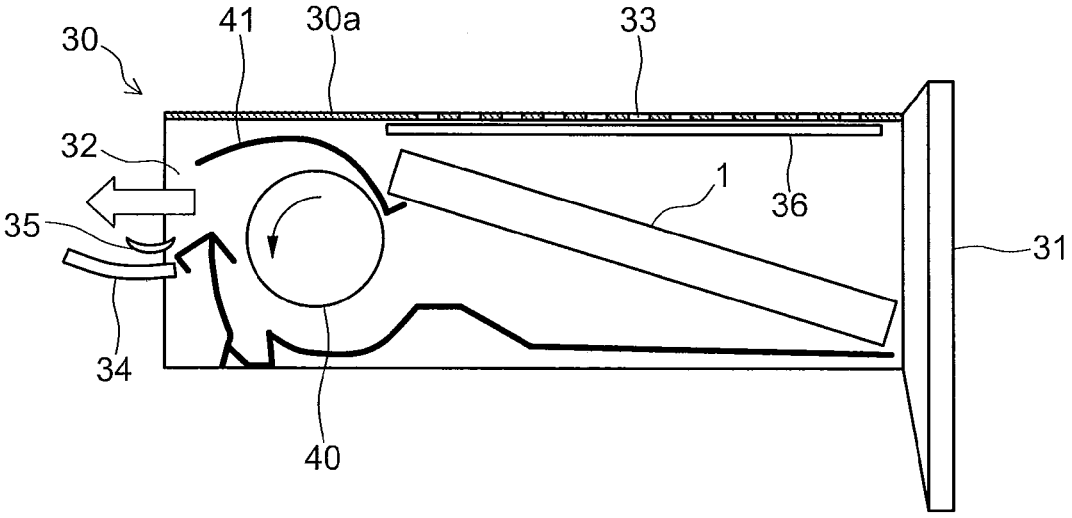
FIG. 8 is a schematic sectional view of an indoor unit of an air conditioner equipped with the heat exchanger according to the present invention.

The above-described heat exchanger 1 can be incorporated in an outdoor unit or an indoor unit of a separate type air conditioner. FIG. 7 shows an example in which the heat exchanger 1 is incorporated in the outdoor unit, and FIG. 8 shows an example in which the heat exchanger 1 is incorporated in the indoor unit.

An outdoor unit 20 shown in FIG. 7 includes a sheet-metal housing 20*a* that is substantially rectangular in plan, longer sides of which constitute a front face 20F and a back face 20B, and shorter sides of which constitute a left side face 20L and a right side face 20R. An exhaust port 21 is formed in the front face 20F, a back-face air intake port 22 is formed in the back face 20B, and a side-face air intake port 23 is formed in the left side face 20L. The exhaust port 21 is an assembly of a plurality of horizontal slit-shaped openings, and the back-face air intake port 22 and the side-face air intake port 23 are lattice-shaped openings. Four sheet-metal members that are the front face 20F, the back face 20B, the left side face 20L, and the right side face 20R, together with unshown top and bottom panels, form the box-shaped housing 20*a*.

Inside the housing 20*a*, a heat exchanger 1 that has an L-shaped thermal plane is disposed on an immediately inner side relative to the back-face air intake port 22 and the side-face air intake port 23. A blower 24 is disposed between the heat exchanger 1 and the exhaust port 21 in order to forcibly cause heat exchange between the heat exchanger 1 and outdoor air. The blower 24 is formed by combining an electric motor 24*a* with a propeller fan 24*b*. In the housing 20*a*, on an inner surface of the front face 20F, a bell mouth 25 is fitted so as to surround the propeller fan 24*b* for improved blowing efficiency. The housing 20*a* includes a space on the inner side relative to the right-side face 20R, which is isolated by a partition wall 26 from an air flow flowing from the back-face air intake port 22 to the exhaust port 21, and a compressor 27 is accommodated in this space.

Condensate water formed in the heat exchanger 1 of the outdoor unit 20 reduces the area of an air flow passage, leading to deteriorated heat exchange performance. Moreover, when an outside air temperature is below the freezing point, the condensate water may even freeze to cause damage to the heat exchanger 1. Thus, in the outdoor unit 20, drainage of condensate water from the heat exchanger 1 is a crucial problem.

In the outdoor unit 20, condensate water gathers on the windward side of the heat exchanger 1. This is because, in the outdoor unit 20, the heat exchanger 1 is installed in a state of not being tilted but standing substantially upright. When the heat exchanger 1 is used as an evaporator (as in, for example, a heating operation), heat exchange is performed more actively on the windward side than on the leeward side, and condensate water is accumulated on the windward side. Thus, the windward side constitutes a condensate-water gathering side.

Condensate water formed on the windward side rarely flows to the leeward side. When an outside air temperature is low, condensate water freezes to the heat exchanger 1 in the form of frost. An increased amount of frost necessitates a defrosting operation. During the defrosting operation, the blower 24 is stopped from operating, and thus water resulting from the defrosting operation flows mainly downward due to gravity without being affected by wind. Thus, providing the structures of the present invention described in Embodiments 1 and 2 at a surface of the heat exchanger 1 on the windward side enables quick drainage of condensate water and can prevent heat exchange performance from being degraded.

An indoor unit 30 shown in FIG. 8 includes a housing 30*a* having the shape of a rectangular parallelepiped that is flat in the vertical direction. The housing 30*a* is fitted to an unshown wall surface inside a room via a base 31 fixed to a back face of the housing 30*a*. The housing 30*a* has a blow-out port 32 at the front thereof and has, in a top face thereof, an intake port 33 that is an assembly of a plurality of slits or an opening partitioned in a lattice shape. The blow-out port 32 is provided with a cover 34 and a wind deflection plate 35. The cover 34 and the wind deflection plate 35 both rotate in a perpendicular plane to be horizontal (in an open state) when the air conditioner is in operation and to be perpendicular (in a closed state) when the air conditioner is out of operation. A filter 36 that collects dust contained in taken-in air is disposed on the inner side relative to the intake port 33.

On the inner side relative to the blow-out port 32, a cross flow fan 40 for forming a blow-out air flow is disposed with an axis thereof set to be horizontal. The cross flow fan 40 is accommodated in a fan casing 41 and made to rotate in the direction indicated by an arrow in FIG. 8 by an unshown electric motor to form an air flow flowing in through the intake port 33 to be blown out through the blow-out port 32.

A heat exchanger 1 is disposed behind the cross flow fan 40. The heat exchanger 1 is disposed within the height of the fan casing 41, in a tilted state where the cross flow fan 40 side thereof is set to be high.

In the indoor unit 30, the lower surface of the heat exchanger 1, which is on the leeward side, constitutes a condensate-water gathering side. A water guide member 10 is disposed at this leeward-side surface of the heat exchanger 1, and a V-shaped notch 6*a* or 6*b* also is formed at each edge of corrugated fins 6 on this side.

The foregoing embodiments of the present invention are not intended to limit the scope of the present invention thereto, and various modifications can be made within the spirit of the invention.

INDUSTRIAL APPLICABILITY

The present invention is broadly applicable to side-flow type parallel-flow heat exchangers.

LIST OF REFERENCE SYMBOLS

1 heat exchanger
2, 3 header pipe
4 flat tube
5 refrigerant passage
6 corrugated fin
6*a*, 6*b* V-shaped notch G gap
7, 8 refrigerant gate
10 water guide member
20 outdoor unit
30 indoor unit

The invention claimed is:

1. A side-flow type parallel-flow heat exchanger, comprising:

a plurality of header pipes that are arranged parallel to each other at an interval;

a plurality of flat tubes that are arranged between the plurality of header pipes and each have inside thereof refrigerant passages communicating with insides of the header pipes; and corrugated fins that are disposed between adjacent ones of the flat tubes, wherein the corrugated fins are longer than the flat tubes in a width direction, wherein the width direction is parallel to a wind direction and a longitudinal direction of contact portions between corrugation peaks of the corrugated fins and the flat tubes, the corrugated fins have protruding portions that do not make contact with the flat tubes thereby creating gaps, a linear water guide member is inserted into the gap between every adjacent protruding portion, a V-shaped notch is formed in each of the protruding portions where condensate water gathers, part of each of the corrugated fins is cut out only at one end thereof in the width direction so as to form the V-shaped notch, and the V-shaped notch is increasingly narrow from the one end in the width direction.

2. The heat exchanger according to claim 1, wherein the V-shaped notch is formed at each of the corrugation peaks and corrugation troughs of the corrugated fins.

3. The heat exchanger according to claim 2, wherein the V-shaped notch has such a notch depth as to expose at least part of one of the water guide members that is in contact with a portion of the corrugated fins where said V-shaped notch is formed.

4. The heat exchanger according to claim 1, wherein the V-shaped notch is formed in each perpendicular wall of the corrugated fins.

5. The heat exchanger according to claim 4, wherein the V-shaped notch is formed so that at least a deepest portion thereof extends deep to above that one of the water guide members which is situated immediately below that one of the corrugated fins in which said V-shaped notch is formed.

6. An outdoor unit of an air conditioner comprising the heat exchanger according to claim 1.

7. An indoor unit of an air conditioner comprising the heat exchanger according to claim 1.

8. An outdoor unit of an air conditioner comprising the heat exchanger according to claim 2.

9. An outdoor unit of an air conditioner comprising the heat exchanger according to claim 3.

10. An outdoor unit of an air conditioner comprising the heat exchanger according to claim 4.

11. An outdoor unit of an air conditioner comprising the heat exchanger according to claim 5.

12. An indoor unit of an air conditioner comprising the heat exchanger according to claim 2.

13. An indoor unit of an air conditioner comprising the heat exchanger according to claim 3.

14. An indoor unit of an air conditioner comprising the heat exchanger according to claim 4.

15. An indoor unit of an air conditioner comprising the heat exchanger according to claim 5.

16. The heat exchanger according to claim 1, wherein the V-shaped notch reaches the flat tubes.

* * * * *